US008985736B2

(12) United States Patent
Akaba et al.

(10) Patent No.: US 8,985,736 B2
(45) Date of Patent: Mar. 24, 2015

(54) IMAGE FORMING APPARATUS HAVING INK JET HEAD AND METHOD FOR PERFORMING MAINTENANCE OF THE SAME

(71) Applicant: Toshiba Tec Kabushiki Kaisha, Shinagawa-ku, Tokyo (JP)

(72) Inventors: Hideyuki Akaba, Kanagawa-ken (JP); Hideaki Nishida, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/762,444

(22) Filed: Feb. 8, 2013

(65) Prior Publication Data

US 2013/0241980 A1 Sep. 19, 2013

(30) Foreign Application Priority Data

Mar. 16, 2012 (JP) ..... 2012-060923

(51) Int. Cl.
*B41J 2/165* (2006.01)
*B41J 2/175* (2006.01)

(52) U.S. Cl.
CPC ..... *B41J 2/175* (2013.01); *B41J 2/16526* (2013.01)
USPC ..... 347/22; 347/23; 347/35; 347/84; 347/85; 347/89; 347/92

(58) Field of Classification Search
CPC ..... B41J 2/175; B41J 2/18
See application file for complete search history.

(56) References Cited

U.S. PATENT DOCUMENTS

| | | | |
|---|---|---|---|
| 6,866,362 | B2 | 3/2005 | Kimura et al. |
| 7,029,090 | B2 | 4/2006 | Nishida et al. |
| 7,083,253 | B2 | 8/2006 | Kimura et al. |
| 2008/0218554 | A1 * | 9/2008 | Inoue ..... 347/33 |

FOREIGN PATENT DOCUMENTS

| | | |
|---|---|---|
| JP | 2005-153355 | 6/2005 |
| JP | 2006-095410 | 4/2006 |
| JP | 2007-203649 | 8/2007 |
| JP | 2008-073594 | 4/2008 |
| JP | 2009-132019 | 6/2009 |

OTHER PUBLICATIONS

Machine translation of JP 2008-073594 A. (JP 2008-073594 A was published on Apr. 3, 2008.).*
Translation of JP 2008-073594 A. (JP 2008-073594 A was published on Apr. 3, 2008.).*
Japanese Office Action for Japanese Patent Application No. 2012-060923 mailed on Mar. 10, 2014.

* cited by examiner

*Primary Examiner* — Justin Seo
(74) *Attorney, Agent, or Firm* — Amin, Turocy & Watson, LLP

(57) ABSTRACT

An image forming apparatus includes an ink jet head, having a pressure chamber, a flow path and a nozzle, which ejects ink in the pressure chamber through the nozzle, a first tank connected to the flow path, a supply unit which supplies ink in the first tank to the pressure chamber through the flow path, a second tank connected to the flow path, a discharge unit which moves ink in the pressure chamber to the second tank through the flow path, and a control section which activates the supply unit and the discharge unit so that ink in the pressure chamber is discharged to the second tank by the discharge unit, ink in the first tank is charged to the pressure chamber by the supply unit and the liquid surface of ink supplied to the pressure chamber is projected from the nozzle.

16 Claims, 17 Drawing Sheets

IMAGE FORMING APPARATUS HAVING INK JET HEAD AND METHOD FOR PERFORMING MAINTENANCE OF THE SAME

CROSS-REFERENCE TO RELATED APPLICATION

This application is based upon and claims the benefit of priority from the prior Japanese Patent Application No. 2012-060923, filed on Mar. 16, 2012, the entire contents of all of which are incorporated herein by reference.

FIELD

The present embodiments relate an image forming apparatus and a method for performing maintenance of the ink jet head of the image forming apparatus.

BACKGROUND

An image forming apparatus such as an ink jet printer ejects ink from the nozzle provided on the ink jet head to form an image. The ink may be coagulated or caked when viscosity thereof is increased because of evaporation of the liquid component and the volatile component of the ink. If ink is caked within the nozzle, it may course failure of printing.

To restrain the failure of printing with the caked ink, it is well known, for example, that pressure applied to the ink in the ink jet head is varied to flow ink nearby the nozzle. The ink is stirred with the flow of ink and thus the coagulation of the ink is restrained.

BRIEF DESCRIPTION OF THE DRAWINGS

Aspects of this disclosure will become apparent upon reading the following detailed description and upon reference to the accompanying drawings. The description and the associated drawings are only provided to illustrate embodiments of the invention and not limited to the scope of the invention, wherein.

DETAILED DESCRIPTION

Figure 1:
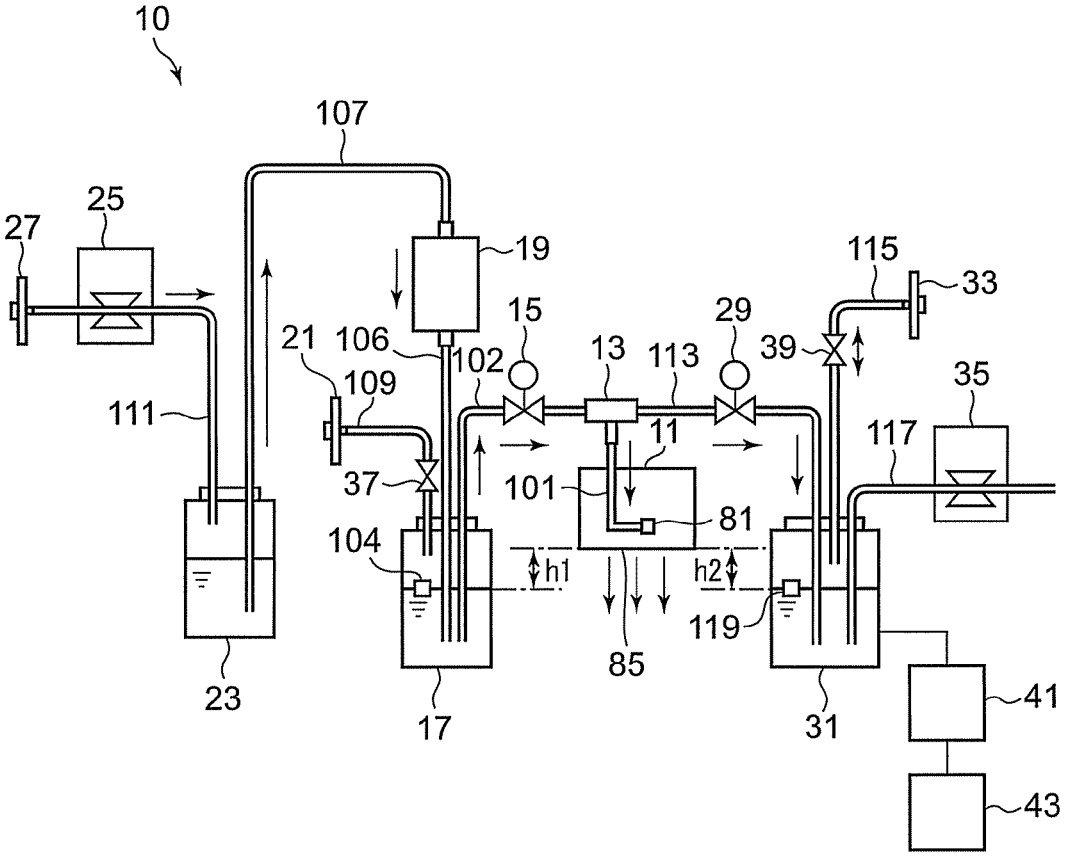
FIG. 1 is a block diagram roughly illustrating construction of a printing apparatus according to a first embodiment.

In general, according to one embodiment, it is to provide an image forming apparatus including an ink jet head, having a pressure chamber in which ink is filled, a flow path fluidly communicating with the pressure chamber and a nozzle open to the pressure chamber, which is configured to eject the ink in the pressure chamber through the nozzle, a first tank connected to the flow path of the head to store ink, a supply unit configured to supply the ink in the first tank to the pressure chamber of the head through the flow path of the head, a second tank connected to the flow path of the head to store ink, a discharge unit configured to move the ink in the pressure chamber of the head to the second tank through the flow path of the head, and a control section configured to activate the supply unit and the discharge unit so that the ink in the pressure chamber is discharged to the second tank by the discharge unit, the ink in the first tank is charged to the pressure chamber by the supply unit and the liquid surface of the ink supplied to the pressure chamber is projected from the nozzle of the head, Embodiments will now be described in more detail with reference to the accompanying drawings. However, the same numerals are applied to the similar elements in the drawings, and therefore, the detailed descriptions thereof are not repeated.

First Embodiment

Figure 16:
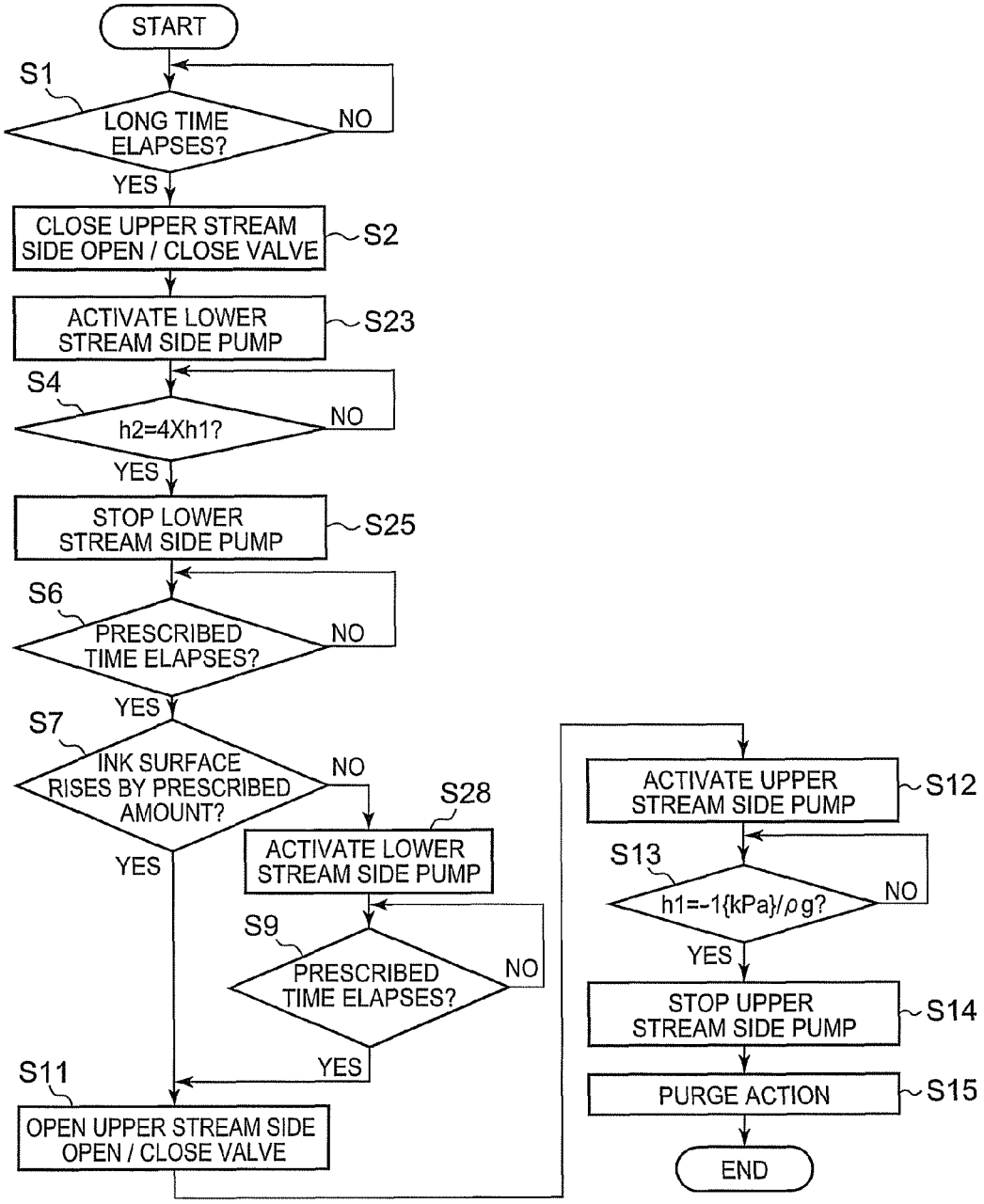
FIG. 16 is a flow chart illustrating another example of the maintenance method in the printing apparatus.

A first embodiment will be described with reference to the FIG. 1 to the FIG. 16. FIG. 1 is a diagram roughly illustrating construction of an ink jet printing apparatus (hereinafter referred to as a printing apparatus) 10. The printing apparatus 10 is an example of an image forming apparatus.

The printing apparatus 10 includes an ink jet head 11, a T-shaped junction 13, an upper-stream side open/close valve 15, a pressure regulation tank 17, a first filter 19, a first disposable filter 21, an upper-stream side ink tank 23, an upper-stream side air pump 25 and a second disposable filter 27. The printing apparatus 10 further includes a lower-stream side open/close valve 29, a lower-stream side ink tank 31, a third disposable filter 33, a lower-stream side suction pump 35, an upper-stream side open/close valve 37, a lower-stream side open/close valve 39, a tank moving mechanism 41 and a control section 43.

The ink jet head 11 is an example of a head. The pressure regulation tank 17 is an example of a first tank. The upper-stream side air pump 25 is an example of a supply unit. The lower-stream side ink tank 31 is an example of a second tank. The lower-stream side suction pump 35 is an example of a pump. The tank moving mechanism 41 is an example of a discharge unit.

Figure 2:
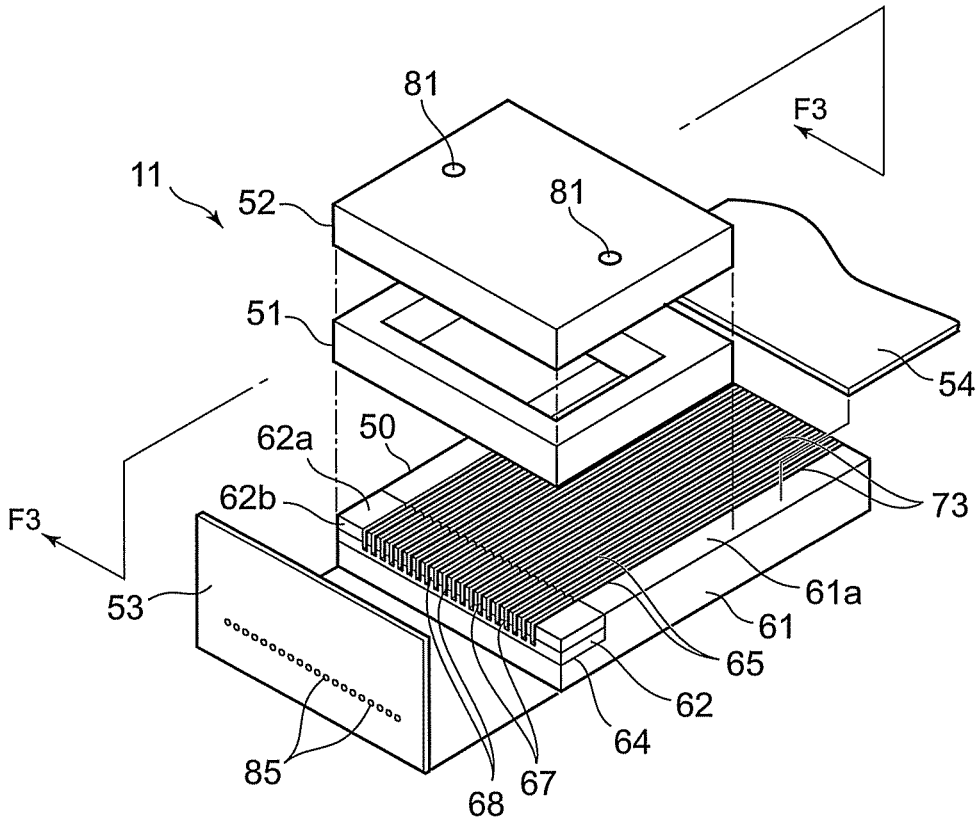
FIG. 2 is an exploded perspective view illustrating an ink jet head according to the first embodiment.
Figure 3:
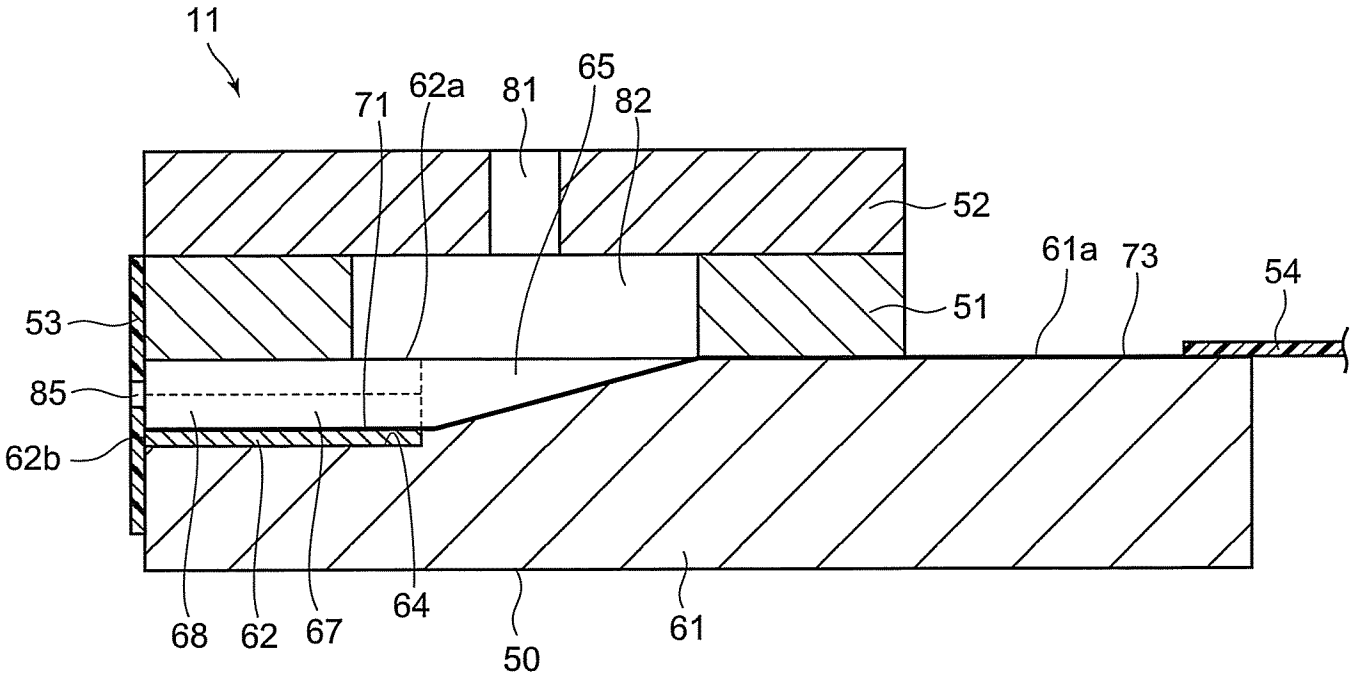
FIG. 3 is a sectional view illustrating the ink jet head, taken along the lines F3-F3 of FIG. 2.

FIG. 2 is an exploded perspective view illustrating an ink jet head 11. FIG. 3 is a sectional view illustrating the ink jet head, taken along the lines F3-F3 of the FIG. 2.

As shown in the FIG. 2, the ink jet head 11 is a so-called shear-mode type ink jet head. The ink jet head 11 includes a head body 50, a frame member 51, a cover member 52, a nozzle plate 53 and a circuit base plate 54.

The head body 50 includes a base member 61 and a piezoelectric member 62. The base member 61 is formed in a rectangular plate shape and is provided with a cut portion 64 and a plurality of grooves 65. The plurality of grooves 65 are formed in parallel with one another. The plurality of grooves 65 open at the upper surface 61*a* of the base member 61 and the cut portion 64, respectively.

The piezoelectric member 62 is formed such that two piezoelectric plates made of lead zinconate titanate are stuck with one another. The two piezoelectric plates are polarized in an opposite direction. The piezoelectric member 62 is deformed by a voltage applied. The piezoelectric member 62 is mounted on the cut portion 64 of the base plate 61.

A plurality of pressure chambers 67 are formed on the piezoelectric member 62. The plurality of pressure chambers 67 are respectively formed in a groove shape and provided in parallel with one another. The plurality of pressure chambers 67 fluidly communicate with the plurality of grooves 65 of the base member 61 one to one manner. Each pressure chamber 67 opens at the upper surface 62*a* and the front surface 62*b* of the piezoelectric member 62.

A pole portion 68 is formed between pressure chambers 67, A plurality of pole portions 68 respectively partition the plurality of pressure chambers 67 and form the side surface of each pressure chamber 67.

As shown in the FIG. 3, a plurality of electrodes 71 are respectively provided on the piezoelectric member 62 and the base member 61. The plurality of electrodes 71 respectively cover the side surface and the bottom surface of the plurality of pressure chambers 67. The plurality of electrodes 71 are continuously extended from the pressure chamber 67 to the groove 65. The electrode 71 is formed with a thin film of nickel, for example. However, it is not limited to this and the electrode 71 may be made of gold or cupper. Pole portions 68 on which the electrode 71 is formed on the both sides thereof act as an actuator.

On the other hand, as shown in the FIG. 2, a plurality of wiring patterns 73 are formed on the upper surface 61*a* of the base member 61. The plurality of wiring patterns 73 are formed, for example, such that a thin film of nickel on the upper surface 61*a* of the base member 61 is processed with patterning by a laser. The plurality of wiring patters 73 respectively extend from the rear end of the upper surface 61*a* of the base member 61. Each one of the end portions of the wiring pattern 73 is connected to the electrode 71.

The circuit base plate 54 is arranged at the other end portion of the wiring pattern 73. The circuit base plate 54 is, for example, a film carrier package including a plastic film on which a plurality of conductor patterns are formed, and an IC (Integrated Circuit) Device connected to the plurality of conductor patterns. The plurality of conductor patterns are electrically connected to the other ends of the plurality of wiring patterns, respectively.

The frame member 51 is mounted on the head body 50 with glue. The cover member 52 is mounted on the frame member 51. An ink supply opening 81 is provided on the cover member 52. Such combined frame member 51 and cover member 52 cover the plurality of pressure chambers 67 from the upper surface 61*a* of the base member 61.

As shown in the FIG. 3, an ink chamber 82 to which ink is supplied is formed in the inside of the combined frame member 51 and cover member 52. The ink chamber 82 is an example of the flow path. The cover member 52 covers the ink chamber 82 by attaching on the frame member 51. The ink supply opening 81 is formed on the cover member 52 and is fluidly communicated with the ink chamber 82. The ink chamber 82 is fluidly communicated with the plurality of pressure chambers 67. Ink supplied to the ink chamber 82 through the ink supply opening 81 is further supplied to each pressure chamber 67.

The nozzle plate 53 is a rectangular shaped film made of polyimide plastic. However, the nozzle plate 53 is not limited to be made of polyimide but may be made of steel such as a stainless steel or other material which is able to be fine-processed by a laser. The nozzle plate 53 is attached on the head body 50 and frame member 51. The nozzle plate 53 covers the plurality of pressure chambers 67 at the side of the front surface 62*b* of the piezoelectric member 62.

A plurality of nozzles 85 are provided on the nozzle plate 53. The nozzles 85 are formed by a laser processing, respectively. As shown in the FIG. 3, the plurality of nozzles 85 open to the plurality of pressure chambers 67, respectively.

In such an ink jet head as described above, the circuit base plate 54 applies a voltage to the electrode 71 through the wiring pattern 73 based on a print signal input from the control section 43. The pole portion 68 to which the voltage is applied performs a shear-mode deformation in response to the print signal. Ink to which pressure is increased is ejected from the corresponding nozzle 85.

The ink jet head 11 is loaded in the printing apparatus 10 such that it is supported by a head support mechanism. As shown in the FIG. 1, one of the ends of a pipe member 101 is connected to the ink supply opening 81 of the ink jet head 11 and the other end thereof is connected to the T-shaped junction 13.

The pressure regulation tank 17 is connected to the upper-stream side of the ink jet head 11 through the T-shaped junction 13 and a pipe member 102. In other words, the pressure regulation tank 17 is connected to the ink chamber 82 of the ink jet head 11.

The upper-stream side open/close valve 15 is arranged at the pipe member 102 between the T-shaped junction 13 and the pressure regulation tank 17. The upper-stream side open/close valve 15 is selectively switched between an open position at which flow of ink from the pressure regulation tank 17 to the ink jet head 11 is allowed and a closed position at which flow of ink between the pressure regulation tank 17 and the ink jet head is shut.

Ink supplied from the upper-stream side ink tank 23 is stored in the pressure regulation tank 17, temporarily. One of the ends of the pipe member 102 is positioned within the ink stored in the pressure regulation tank 17 such that it is slightly apart from the bottom surface of the pressure regulation tank 17. A first hydraulic head sensor 104 is arranged in the pressure regulation tank 17. The first hydraulic head sensor 104 varies its output in response to the position of the gas-liquid boundary surface of ink and air, i.e., surface of ink, stored in the pressure regulation tank 17. The first hydraulic head sensor 104 is a float type level sensor, for example, However, the first hydraulic head sensor 104 may be other sensor such as a photo-sensor.

A pipe member 106 is connected to the pressure regulating tank 17. One of the ends of the pipe member 106 is positioned within the ink stored in the pressure regulation tank 17 such that it is slightly apart from the bottom surface of the pressure regulation tank 17, and the other end thereof is connected to the first filter 19.

A pipe member 107 is connected to the first filter 19. The first filter 19 removes a foreign substance contained in the ink flowing from the pipe member 107 located at the upper-stream side of the first filter 19 to the pipe member 106 located at the lower-stream side of the first filter 19 thereby providing ink from which a foreign substance is removed to the pressure regulation tank 17.

The first filter 19 is connected to the upper-stream side ink tank 23 through the pipe member 107. One end of the pipe member 107 is positioned within the ink stored in the upper-stream side ink tank 23 such that it is slightly apart from the bottom surface of the upper-stream side ink tank 23.

A pipe member 109 is connected to the pressure regulation tank 17. One of the ends of the pipe member 109 is positioned within the air in the pressure regulation tank 17 such that it is slightly apart from the gas-liquid boundary surface (ink surface) between the ink and the air in the pressure regulation tank 17. The other end of the pipe member 109 is connected to the first disposable filter 21. The first disposable filter 21 removes a foreign substance contained in the air flowing into the pressure regulation tank 17 through the pipe member 109. The upper-stream side open/close valve 37 is provided at the pipe member 109.

The upper-stream side ink tank 23 is connected to the upper-stream side air pump 25 through a pipe member 111. The upper-stream side ink tank 23 stores ink supplied to the ink jet head 11. The upper-stream side ink tank 23 is able to be supplemented with ink.

One of the ends of the pipe member 111 is positioned within the air in the upper-stream side ink tank 23 such that it is slightly apart from the gas-liquid boundary surface between the air and the ink. The other end of the pipe member 111 is connected to the second disposable filter 27. The second disposable filter 27 removes a foreign substance contained in the air flowing into the upper-stream side ink tank 23 through the pipe member 111 thereby providing air from which a foreign substance is removed to the upper-stream side ink tank 23.

At the lower-stream side of the ink jet head 11, the lower-stream side ink tank 31 in which ink is stored is connected through the T-shaped junction 13 and a pipe member 113. In more detail, the lower-stream side ink tank 31 is connected to the ink chamber 82 of the ink jet head 11. One end of the pipe member 113 is positioned within the ink in the lower-stream side ink tank 31 such that it is slightly apart from the bottom surface of the lower-stream side ink tank 31.

The lower-stream side open/close valve 29 is provided at the pipe member 113, as shown in the FIG. 1. The lower-stream side open/close valve 29 is selectively switched between an open position at which the ink flow from the ink jet head 11 to the lower-stream side ink tank 31 is allowed and a shut down position at which the ink flow between the ink jet head and the lower-stream side ink tank 31 is inhibited.

A pipe member 115 is connected to the lower-stream side ink tank 31. One of the ends of the pipe member 115 is positioned within the air in the lower-stream side ink tank 31 such that it is slightly apart from the gas-liquid boundary surface, i.e., ink surface, between the air and the ink in the lower-stream side ink tank 31. The other end of the pipe member 115 is connected to the third disposable filter 33. The third disposable filter 33 removes a foreign substance contained in the air flowing into the lower-stream side ink tank 31 through the pipe member 115. The pipe member 115 is provided with the lower-stream side ink tank 39.

The lower-stream side ink tank 31 is provided with a second hydraulic head sensor 119. The second hydraulic head sensor 119 varies its output in response to the position of the gas-liquid boundary surface of the ink and the air, i.e., surface of ink, stored in the lower-stream side ink tank 31. The second hydraulic head sensor 119 is a float type level sensor, for example, however, the second hydraulic head sensor 119 may be other sensor such as a photo-sensor.

The tank moving mechanism 41 moves the lower-stream side ink tank 31 in a vertical direction, for example. The tank moving mechanism 41 comprises a gear, a piston and other mechanism to move the lower-stream side ink tank 31.

The control section 43 functions as hardware elements such as an IC, a memory, a circuit board and others to control various hardware components of the printing apparatus 10. For example, control section 43 issues a print command to the ink jet head 11 responding to the operation by a user. The control section 43 makes the upper-stream side open/close valve 15, the lower-stream side open/close valve 29, the upper-stream side open/close valve 37 and the lower-stream side open/close valve 39 open or close. The control section 43 also makes the upper-stream side air pump 25 and the lower-stream side suction pump 35 start or stop. The control section 43 moves the lower-stream side ink tank 31 through the ink moving mechanism 41.

In the following, a method for filling or charging ink in the ink jet head 11 will be described with reference to the FIG. 1.

Firstly, the upper-stream side open/close valve 37 is set to the shut down position and the upper-stream side open/close valve 15 and the lower-stream side open/close valve 29 are set to the open position respectively. Then, the upper-stream side air pump 25 is activated to feed air into the upper-stream side ink tank 23. The internal pressure of the upper-stream side ink tank 23 is increased with the air fed to the ink tank 23. When the internal pressure of the upper-stream side ink tank 23 is increased to a given value, the ink stored in the upper-stream side ink tank 23 is pushed out to the pipe member 107, as shown by an arrow in the FIG. 1, with the increased internal pressure of the upper-stream side ink tank 23.

The ink pushed out of the upper-stream side ink tank 23 is conveyed to the first filter 19 through the pipe member 107. In the ink conveyed to the first filter 19, a foreign substance contained in the ink is removed while the ink passes through the first filter 19 and then the ink is further conveyed to the pressure regulation tank 17.

When ink is filled in the pressure regulation tank 17 by a given amount, the air in the pressure regulation tank 17 is compressed. When the pressure in the pressure regulation tank 17 reaches at a prescribed level, the ink in the pressure regulation tank 17 is pushed out to the pipe member 102 with the increased internal pressure in the pressure regulation tank 17, as shown by the arrow in the FIG. 1.

The ink pushed out of the pressure regulation tank 17 is fed to the ink supply opening 81 of the ink jet head 11 through the pipe member 102 and the T-shaped junction 13. Then, as shown in the FIG. 3, the ink from the ink supply opening 81 is charged to the plurality of pressure chamber 67 through the ink chamber 82, respectively. The ink charged to the pressure chamber 67 finally reaches at the nozzle 85.

In explaining the above description with other expression, the upper-stream side air pump 25 supplies ink in the pressure regulation tank 17 to the pressure chamber 67 through the ink chamber 82 shown in the FIG. 3. Furthermore, in other words, the pressure regulation tank 17, the upper-stream side ink tank 23 and the upper-stream side air pump 25 supply ink to the pressure chamber 67. The upper-stream side ink tank 23 and the upper-stream side air pump 25 are an example of element which functions as a supply device (first device).

When ink is filled in the pressure chamber 67, the ink pushed out of the pressure regulation tank 17 is supplied to the lower-stream side ink tank 31 through the pipe member 113 and the lower-stream side open/close valve 29.

In a state that the ink jet head 11 does not eject ink, a proper pressure (Pn) in the nozzle 85 is set to be −1 (kPa), for example, with the hydraulic head. That is, the height difference (h1) between the nozzle 85 of the ink jet head 11 and the gas-liquid boundary surface of the ink in the pressure regulation tank 17 is set to be a prescribed amount so that a formula (h1=−1(kPa)/ρg) is satisfied, wherein, ρ is the density of ink and g is the acceleration of gravity. Besides, the height difference (h1) is detected by the first hydraulic head sensor 104 arranged in the pressure regulation tank 17.

A height difference (h2) between the nozzle 85 of the ink jet head 11 and the gas-liquid boundary surface of the ink in the lower-stream side ink tank 31 is set to be equal to the height difference (h1). However, the height difference (h2) may be set to be greater than the height difference (h1). In other words, the lower-stream side ink tank 13 is arranged at a height the same as that of the pressure regulation tank 17 or lower than that of the pressure regulation tank 17.

Next, an example of the maintenance method of the printing apparatus 10 including the above-described construction will be described with reference to the FIGS. 4 and 5. For example, the control section 43 executes the maintenance of the printing apparatus 10 in case that the printing apparatus 10 is not used for a long time or the print-standby state thereof is continued for a relatively long time.

Figure 4:
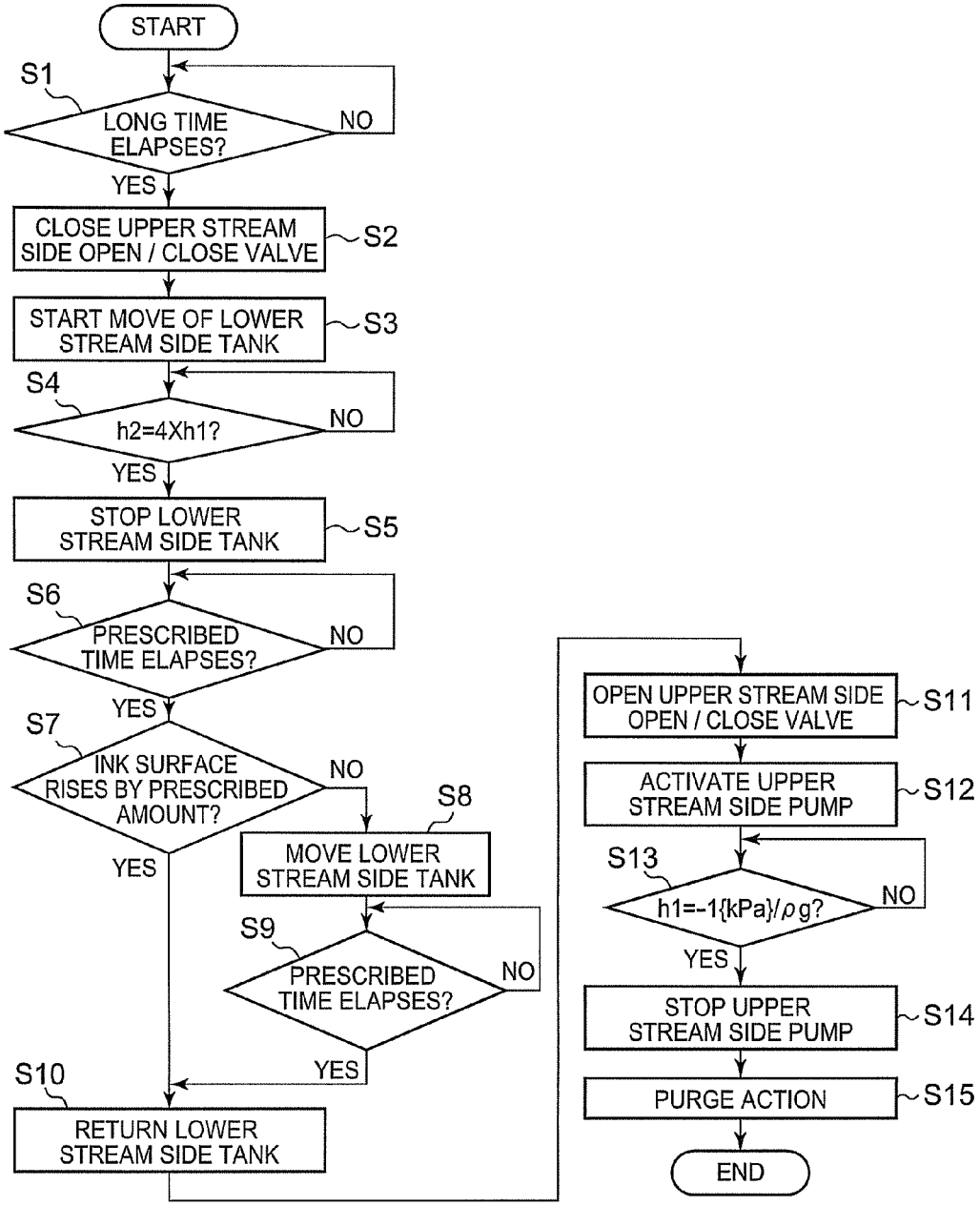
FIG. 4 is a flow chart showing one example of a method for performing maintenance of the printing apparatus shown in FIG. 1.

FIG. 4 is a flow chart illustrating an example of the maintenance method of the printing apparatus 10. FIG. 5 is a block diagram roughly illustrating the printing apparatus 10 when the meniscus is pulled back.

As shown in the FIG. 4, in case in which the printing apparatus 10 is not used for a long time or the print-standby state thereof is continued for a relatively long time (Act S1), the proper pressure (Pn) of the nozzle 85 is controlled by a well known negative pressure generation means. A meniscus of the ink formed in the nozzle 85 is pulled back by setting the pressure of the nozzle 85 at a negative pressure value greater than the normal negative pressure value (−1(kPa)).

In more detail, firstly, the upper-stream side open/close valve 15 positioned between the pressure regulation tank 17 and the ink jet head 11 is set to the shut down position at which the flow of ink is prevented (ACT S2).

Next, the lower-stream side ink tank 31 is moved downward by the tank moving mechanism 41 (ACT S3). As shown in the FIG. 5, the height difference (h2) between the nozzle 85 of the ink jet head 11 and the gas-liquid boundary surface of the ink in the lower-stream side ink tank 31 is increased when the lower-stream side ink tank 31 is moved downward.

The height difference (h2) reaches, for example, at four times the height difference (h1) between the nozzle 85 and the gas-liquid boundary surface of the ink in the pressure regulation tank 17 (YES in ACT S4), the tank moving mechanism 41 is stopped (ACT S5). When the height difference (h2) reaches at four times the height difference (h1), the proper pressure (Pn) of the nozzle 85 is to be −4(kPa). That is, when the lower-stream side ink tank 31 is moved, the negative pressure in the nozzle 85 is increased from the proper pressure (Pn: −1(kPa)) therein at the standby state. The height difference (h2) is detected by the second hydraulic head sensor 119.

Figure 5:
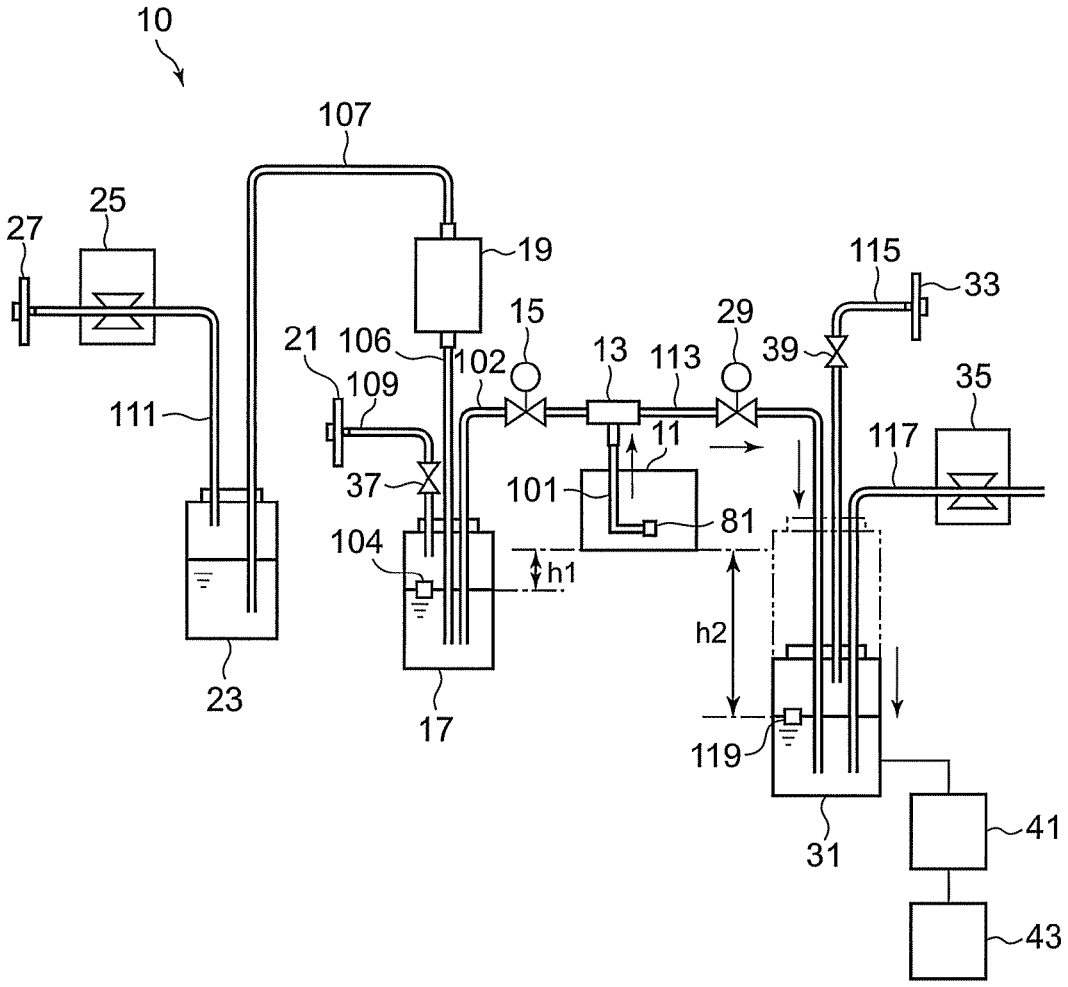
FIG. 5 is a block diagram roughly showing the printing apparatus at a state that a meniscus is pulled back.

By increasing the negative pressure, the ink in the ink jet head 11 flows toward the lower-stream side ink tank 31 through the pipe member 101, the T-shaped junction 13 and the pipe member 113, as shown by the arrow in the FIG. 5. In other words, ink charged in the pressure chamber 67 of the ink jet head 11 is sucked into the lower-stream side ink tank 31.

As described above, the tank moving mechanism 41 increases the height difference (h2) between the nozzle 85 and the ink surface in the lower-stream side ink tank 31 by moving the lower-stream side ink tank 31. When the height difference (h2) is increased, the pressure in the nozzle 85 is decreased and thus the ink in the pressure chamber 67 of the ink jet head 11 moves to the lower-stream side ink tank 31 through the ink chamber 82. In other words, the lower-stream side ink tank 31 and the tank moving mechanism 41 suck ink charged in the pressure chamber 67. The lower-stream side ink tank 31 and the tank moving mechanism 41 are one example of the element which functions as a second unit.

It should be noted that the height difference (h2) at a position that the tank moving mechanism 41 stops is not limited to the above (h2 is four times h1). The height difference (h2) may be a given degree that the ink in the ink jet head 11 is smoothly sucked into the lower-stream side ink tank 31.

Figure 6:
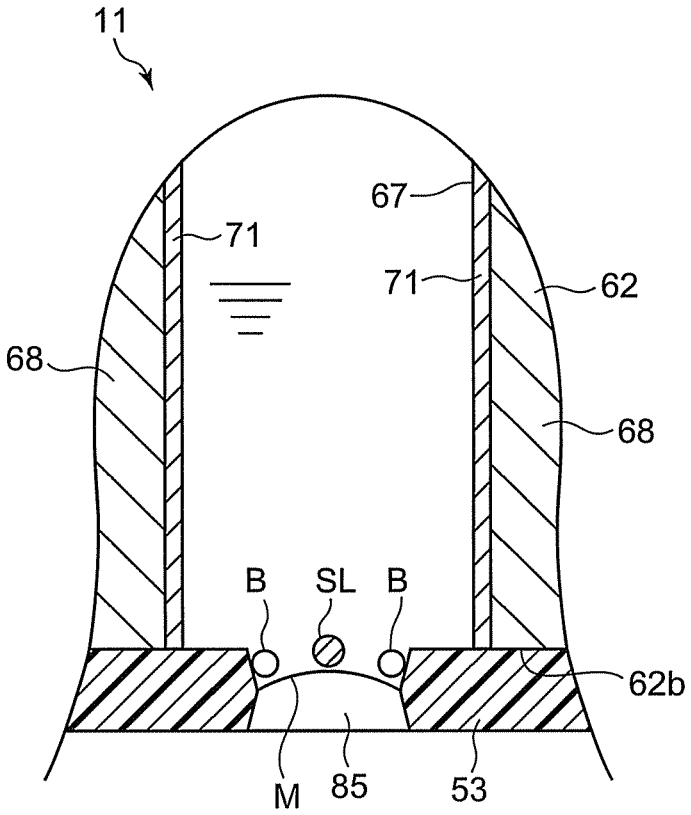
FIG. 6 is a sectional view illustrating the pressure chamber and the nozzle of the ink jet head.
Figure 7:
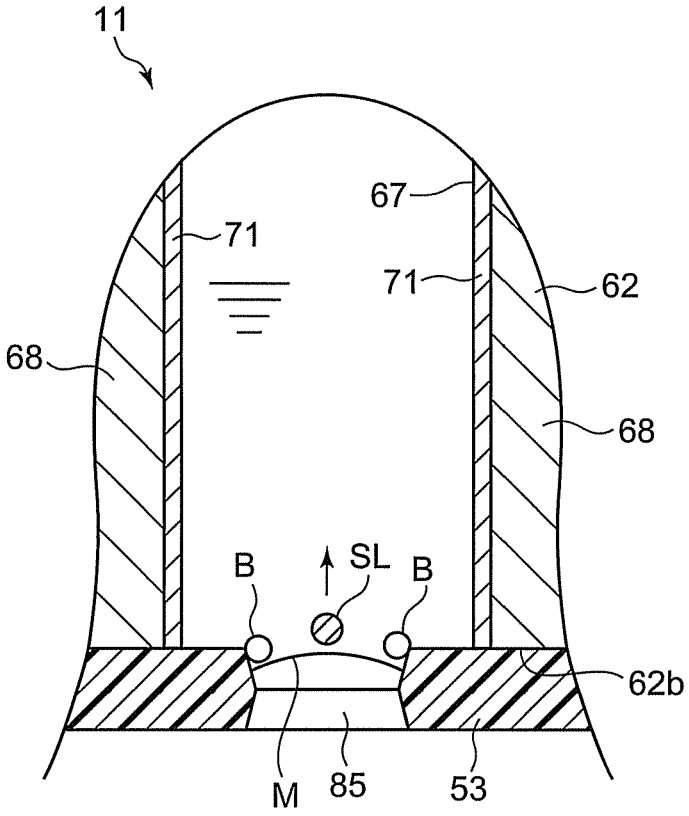
FIG. 7 is a sectional view illustrating a state in which the meniscus is withdrawn from the nozzle in the ink jet head.
Figure 8:
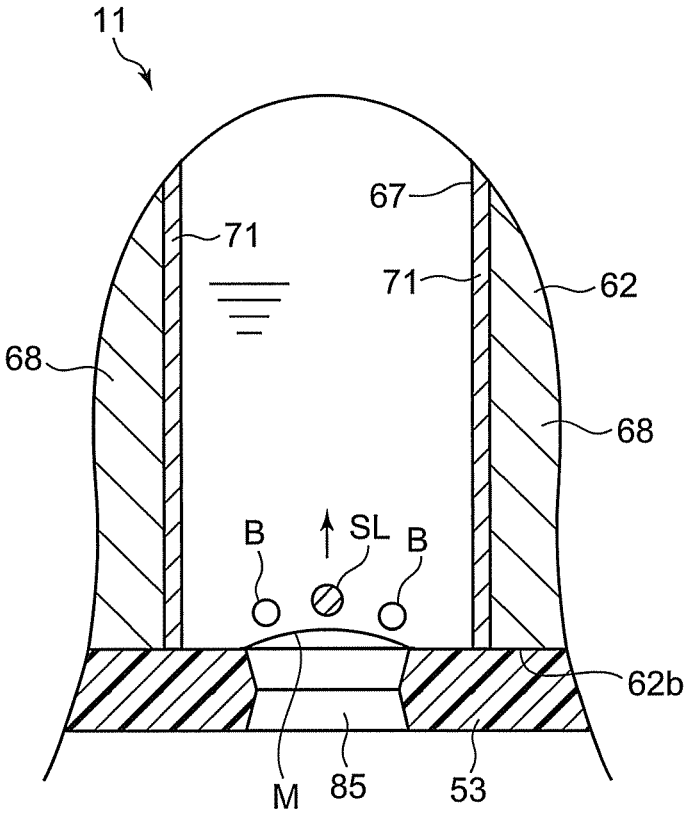
FIG. 8 is a sectional view illustrating a state in which the meniscus is further withdrawn from the state shown in FIG. 7 in the ink jet head.
Figure 9:
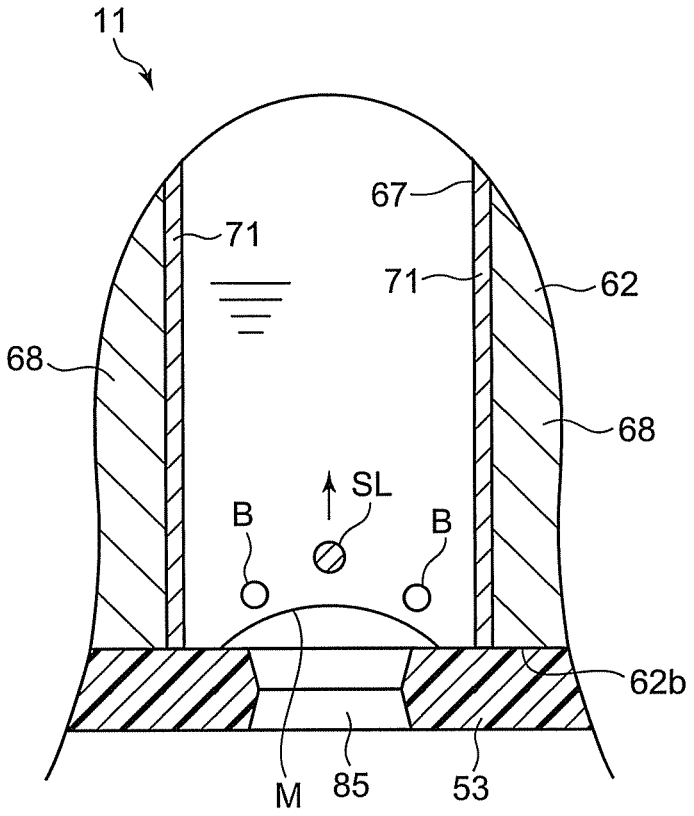
FIG. 9 is a sectional view illustrating a state in which the meniscus is sill further withdrawn from the state shown in FIG. 8 in the ink jet head.
Figure 10:
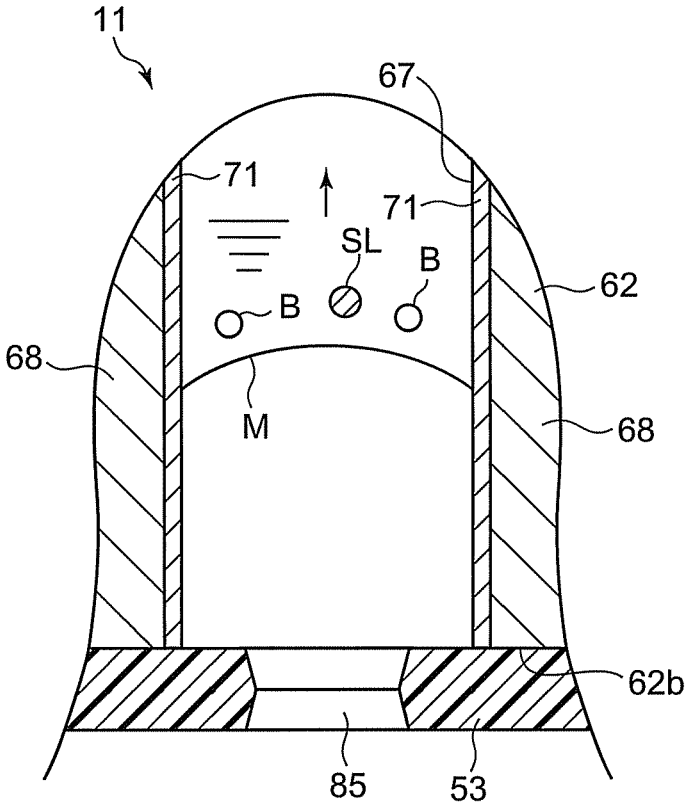
FIG. 10 is a sectional view illustrating a state in which the meniscus is further withdrawn from the state shown in FIG. 9 in the ink jet head.

FIG. 6 is a sectional view illustrating the pressure chamber 67 and the nozzle 85 of the ink jet head 11. FIG. 7 is a sectional view illustrating a state in which the meniscus M is pulled back from the nozzle 85 of the ink jet head 11. FIG. 8 is a sectional view illustrating a state in which the meniscus M is further pulled back from the state shown in the FIG. 7. FIG. 9 is a sectional view illustrating a state in which the meniscus M is still further pulled back from the state shown in the FIG. 8. FIG. 10 is a sectional view illustrating a state in which the meniscus M is pulled back from the state shown in the FIG. 9.

As shown in the FIG. 6, the bubble B and the caked ink SL are contained in the ink charged in the pressure chamber 67. If the bubble B and the caked ink SL are present in the nozzle 85, it may cause failure of ink ejection by the ink jet head 11.

As shown in the FIGS. 6 to 10, when the ink charged in the pressure chamber 67 is sucked, the meniscus M (liquid surface) charged in the pressure chamber 67 is moved to the inside of the pressure chamber 67 from the nozzle 85. The bubble B and the caked ink SL presented in the nozzle 85 are flown together with the ink because of moving the meniscus M. The bubble B and the caked ink SL are conveyed with the flow of the ink from the nozzle 85 to the lower-stream side ink tank 31.

With the elapse of the time, the ink charged in the pressure chamber 67 is discharged to the lower-stream side ink tank 31 and thus the pressure chamber 67 becomes empty. In other words, ink is discharged from the pressure chamber 67 by the lower-stream side ink tank 31 and the tank moving mechanism 41. Note that a certain amount of ink may be left in the pressure chamber 31.

As shown in the FIG. 4, the control section 43 determines whether or not the gas-liquid boundary surface of the ink, i.e., ink surface, in the lower-stream side ink tank 31 raises by a predetermined height (ACT S7) after a prescribed time elapses from the moving of the lower-stream side ink tank 31. (YES in ACT S6). The predetermined time is a time required to discharge all of the ink charged in the plurality of pressure chambers 67 to the lower-stream side ink tank 31, for example. The predetermined height is a height to which the ink surface raises when all of the ink charged in the plurality of pressure chambers 67 is conveyed to the lower-stream side ink tank 31, for example. In other words, the control section 43 judges whether or not the pressure chamber 67 is empty. The increasing amount of the gas-liquid boundary surface of the ink in the lower-stream side ink tank 31 is detected by the second hydraulic head sensor 119.

The control section 43 further moves downward the lower-stream side ink tank 31 by the tank moving mechanism 41 (ACT S8), if the ink surface in the lower-stream side ink tank 31 does not rise by a prescribed height (NO in ACT S7). For example, the control section 43 drives the tank moving mechanism 41 so that the height difference h2 shown in the FIG. 5 becomes five times the height difference h1.

When the height difference h2 reaches at five times the height difference h1, the proper pressure value Pn of the nozzle 85 becomes −5 (kPa). That is, the negative pressure in the nozzle 85 further increases and thus the ink remaining in the pressure chamber 67 is discharged.

On the other hand, if the ink surface in the lower-stream side ink tank 31 rises at a prescribed height (YES in ACT S7) or a given time elapses after the height difference h2 comes five times the height difference h1 (YES in ACT S9), the control section 43 returns the lower-stream side ink tank 31 to the standby position by the tank moving mechanism 41 (ACT S10). In other words, the tank moving mechanism 41 moves the lower-stream side ink tank 31 so that the height difference h2 comes to be equal to the height difference h1.

Next, the upper-stream side open/close valve 15 is set at the open position (ACT S11), and ink is charged to the pressure chamber 67 of the ink jet head 11. As described above, the ink in the upper-stream side ink tank 23 is fed to the pressure regulation tank 17 and thus the ink in the pressure regulation tank 17 is conveyed to the ink jet head 11 by activating the upper-stream side air pump 25 (ACT S12).

Figure 11:
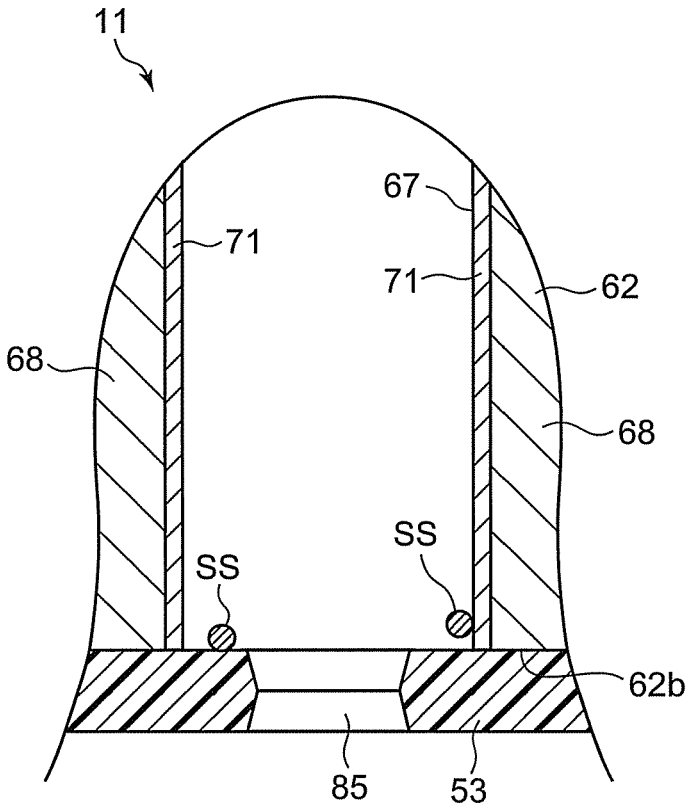
FIG. 11 is a sectional view illustrating the empty pressure chamber and nozzle of the ink jet head.
Figure 12:
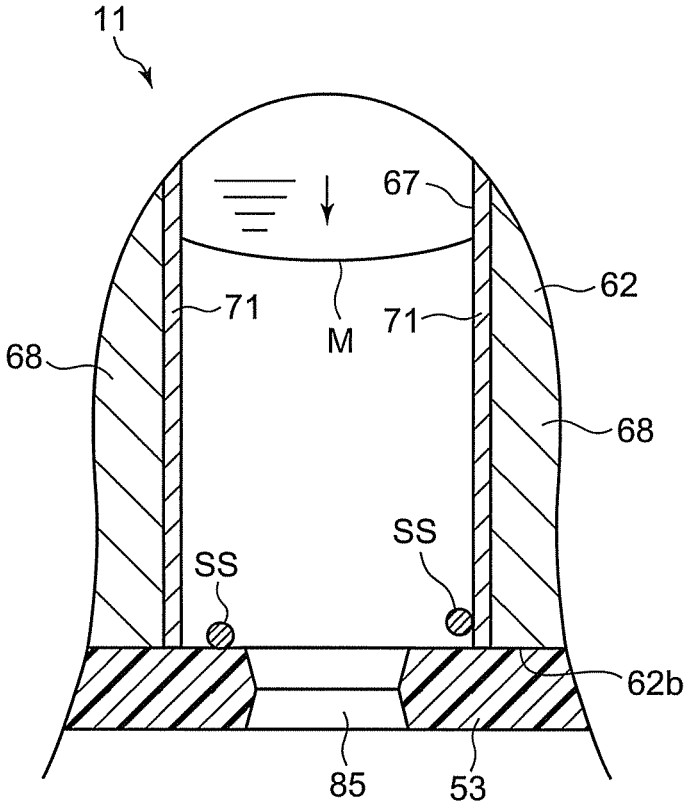
FIG. 12 is a sectional view illustrating a state in which ink is supplied to the pressure chamber in the ink jet head.
Figure 13:
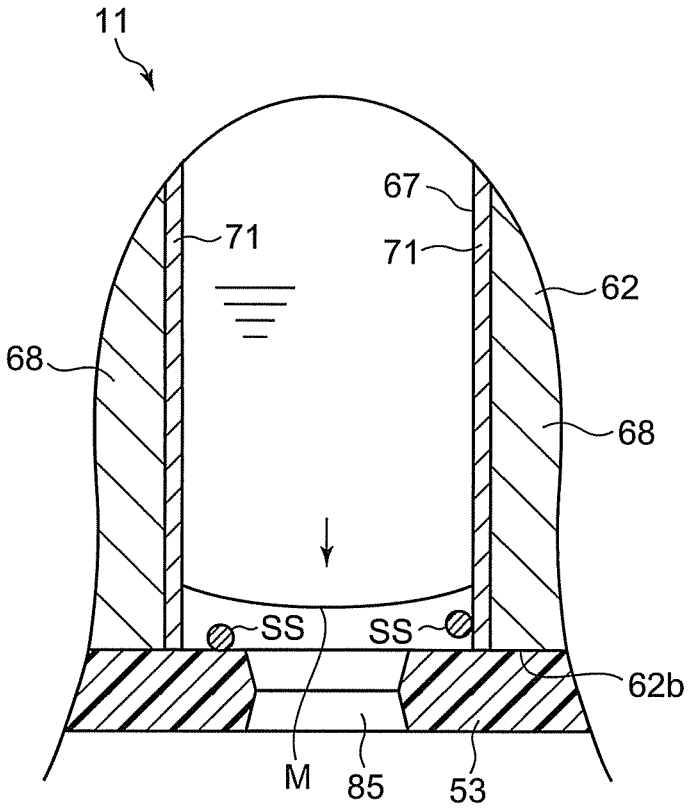
FIG. 13 is a sectional view illustrating a state in which ink is further supplied to the pressure chamber from the state shown in FIG. 12 in the ink jet head.
Figure 14:
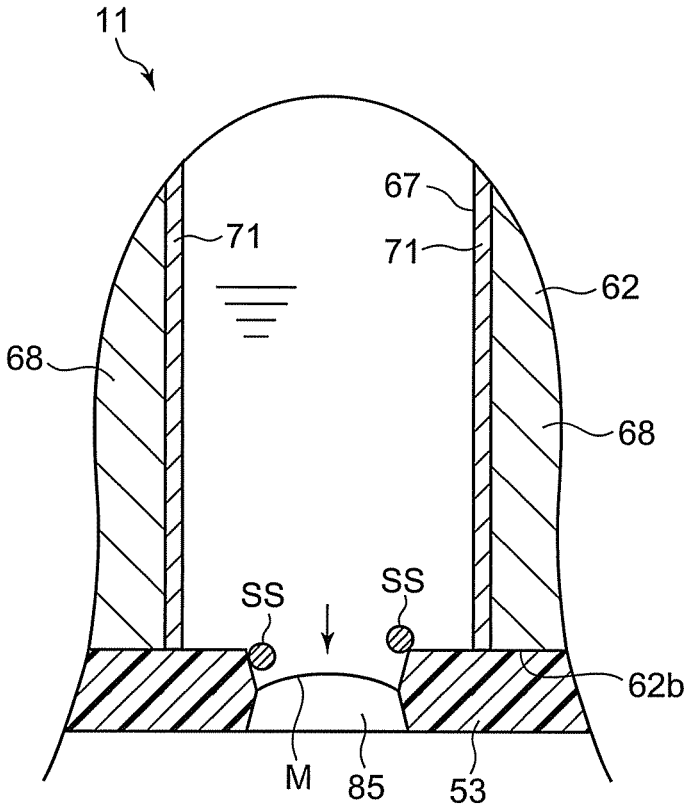
FIG. 14 is a sectional view illustrating a state in which ink is charged in the pressure chamber in the ink jet head.
Figure 15:
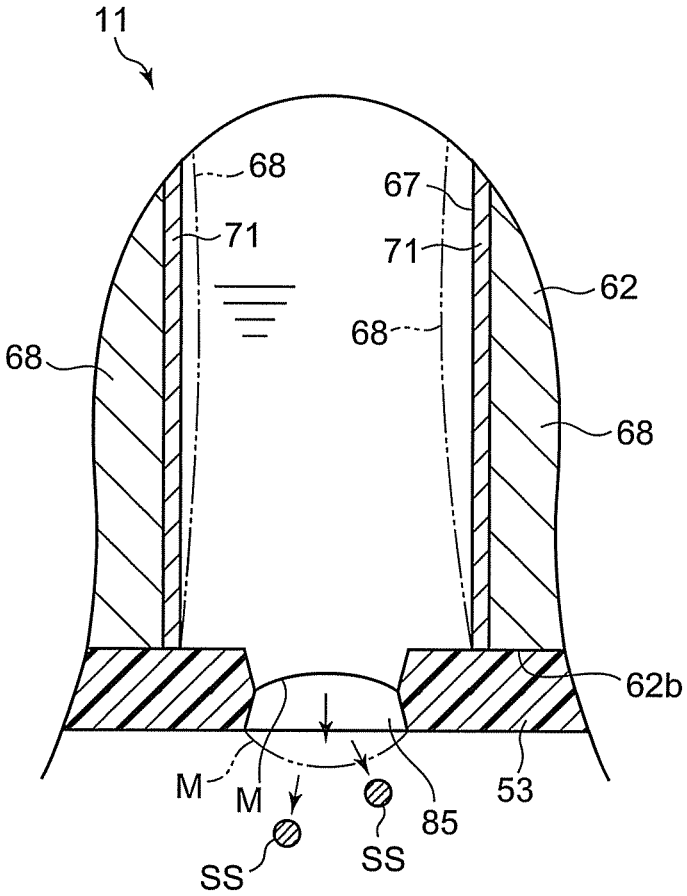
FIG. 15 is a sectional view illustrating the ink jet head in which a purge operation is performed.

FIG. 11 is a sectional view illustrating a state that the pressure chamber 11 and the nozzle 85 of the ink jet head 11 are empty. FIG. 12 is a sectional view illustrating a state in which ink is supplied to the pressure chamber 67. FIG. 13 is a sectional view illustrating a state in which ink is further supplied to the pressure chamber 67. FIG. 14 is a sectional view illustrating a state that ink is filled in the pressure chamber 67. FIG. 15 is a sectional view illustrating the ink jet head 11 which performs the purge action.

When ink is fed to the ink jet head 11, the ink is supplied to the pressure chamber 67. The ink supplied flows within the pressure chamber 67, as shown in the FIGS. 11 to 15, to be filled in the pressure chamber 67. That is, a fresh ink stored in the upper-stream side ink tank 23 is charged to the pressure chamber 67 by the upper-stream side air pump 25, the upper-stream side ink tank 23 and the pressure regulation tank 17.

As shown in the FIG. 11, there is a possibility that a caked ink SS smaller in size than the caked ink SL discharged remains in the pressure chamber 67. As shown in the FIGS. 12 and 13, charging of ink to the pressure chamber 67 begins when ink is conveyed to the ink jet head 11. After that, as shown in the FIG. 14, ink is filled in the pressure chamber 67. While ink is filled in the pressure chamber 67, the caked ink SS is forcibly moved toward the nozzle 85 with the ink and the meniscus M of the ink.

As shown in the FIG. 4, the height difference h1 becomes −1 (kPa)/ρg by filling ink in the pressure chamber 11 (YES in ACT S13 in the FIG. 4), the control section 43 stops the upper-stream side air pump (ACT S14). However, it is not limited to that, and the upper-stream side air pump 25 may operate continuously.

After ink is filled in the pressure chamber 67, the above-described purge action is performed (ACT S15). That is, the control section 43 applies voltage to the electrode 71 by the circuit board 54 of the ink jet head 11. When the voltage is applied to the electrode 71, the pole portion 68 is deformed in a shear mode, as shown by the two-dot chain line in the FIG. 15. The ink filled in the pressure chamber 67 is pressurized by the shear mode deformation of the pole portion 68.

As shown by the two-dot chain line in the FIG. 15, the meniscus M of the ink projects from the nozzle 85 of the ink jet head 11 when the ink is pressurized. Thus, the ink and the meniscus M of the ink projected to the outside of the nozzle 85 of the ink jet head 11 discharge the caked ink SS from the nozzle 85 to the outside of the ink jet head 11.

After the ink and the meniscus M thereof project to the outside of the nozzle 85 of the ink jet head 11, the shear mode deformation of the pole portion 68 is released. As shown by the solid line in the FIG. 15, when the shear mode deformation of the pole portion 68 is released, the ink and the meniscus M thereof are returned to the inside of the nozzle 85 of the ink jet head 11. In other words, the ink and the meniscus M thereof temporarily project to the outside of the nozzle 85 in the purge action. Then, the maintenance of the printing apparatus 10 is completed and the bubble B and the caked inks SL, SS which are present in the pressure chamber 67 and the nozzle 85 are finally discharged.

Instead of the above-described purge action, ink may be ejected from the nozzle 85, for example. When the pole portion 68 performs the shear mode deformation, the ink droplet including the caked ink SS is ejected from the nozzle 85 and thus the caked ink SS is discharged from the pressure chamber 67 and the nozzle 85.

The purge action is not limited to the above but other method may be adopted. For example, the height difference h1 is decreased by moving the pressure regulation tank 17, and whereby the ink charged in the pressure chamber 67 is pressurized and then the ink and the meniscus M of the ink project to the outside of the nozzle 85.

It should be noted that the maintenance method of the printing apparatus 10 is not limited to the above-described method. FIG. 16 is a flow chart showing another example of the maintenance method of the printing apparatus 10. As shown in the FIG. 16, the ink in the lower-stream side ink tank 31 is discharged by activating the lower-stream side suction pump 35 (ACT S23), instead of moving the lower-stream side ink tank 31 by the tank moving mechanism 41. By discharging ink, the gas-liquid boundary surface in the lower-stream side ink tank 31 moves downward.

By moving the gas-liquid boundary surface downward, the height difference h2 becomes four times the height difference h1 and the proper pressure Pn in the nozzle 85 increases to −4 (kPa). When the negative pressure is increased, the ink in the ink jet head 11 flows as shown by the arrow in the FIG. 5. The meniscus M of the ink in the pressure chamber 67 is pulled back because of the flow of ink, as shown in the FIGS. 6 to 10. The lower-stream side suction pump 35 is stopped when the height difference h2 becomes four times the height difference h1 (ACT S25). After that, the lower-stream side suction pump 35 is activated to further move the gas-liquid boundary surface in the lower-stream side ink tank 31 downward (ACT S28) if the gas-liquid boundary surface (ink surface) in the lower-stream side ink tank 31 does not rise at a prescribed height (NO in ACT S7).

By the above-described another maintenance method also, the ink filled in the pressure chamber 67 of the ink jet head 11 is discharged to the lower-stream side ink tank 31. In this another maintenance method, the lower-stream side ink tank 31 is an example of a discharge unit and a combination of the lower-stream side suction pump 35 and the lower-stream side ink tank 31 is an example of an element which functions as a second unit. However, the unit which conveys the ink in the pressure chamber 67 to the lower-stream side ink tank 31 is not limited to the combination of the lower-stream side suction pump 35 and the lower-stream side ink tank 31 but several other units may be adopted.

According to the printing apparatus 10 having the above construction, the control section 43 discharges the ink in the pressure chamber 67 to the lower-stream side ink tank 31 and charges the ink in the pressure regulation tank 17 to the pressure chamber 67. Furthermore the control section 43 projects the meniscus M of the ink supplied to the pressure chamber 67 from the nozzle 85 to the outside of the ink jet head 11. Therefore, the babble B and the caked ink SL, SS existing in the nozzle 85 are able to flow and thus they are removed from the nozzle 85. As a result, the surface of the nozzle 85 is wetted with a fresh ink when print is performed and thus, for example, clogging of the nozzle 85 with ink whose viscosity is increased, failure of the ink-ejection and the ink-ejection in an undesired direction are restrained. That is, failure of printing with the caked ink can be restrained.

The control section 43 charges ink in the pressure regulation tank 17 to the pressure chamber 67 of the ink jet head 11 to perform the purge action after discharging ink in the pressure chamber 67 to the lower-stream side ink tank 31. By discharging the ink to the lower-stream side ink tank 31 beforehand, it is restrained that the nozzle 85 is clogged with the caked ink SL. Furthermore, it is also restrained that bubbles are generated in the pressure chamber 67 and the nozzle 85 because the ink-discharging which causes the suction of air from the nozzle 85 is carried out beforehand.

Second Embodiment

A second embodiment will be described with reference to the FIG. 17. In the following embodiment, the same reference numerals in the Figures are applied to the similar component elements in the FIG. 17 having the same functions as the printing apparatus 10 in the first embodiment, and therefore, the detailed descriptions in whole or in part thereof are not repeated.

Figure 17:
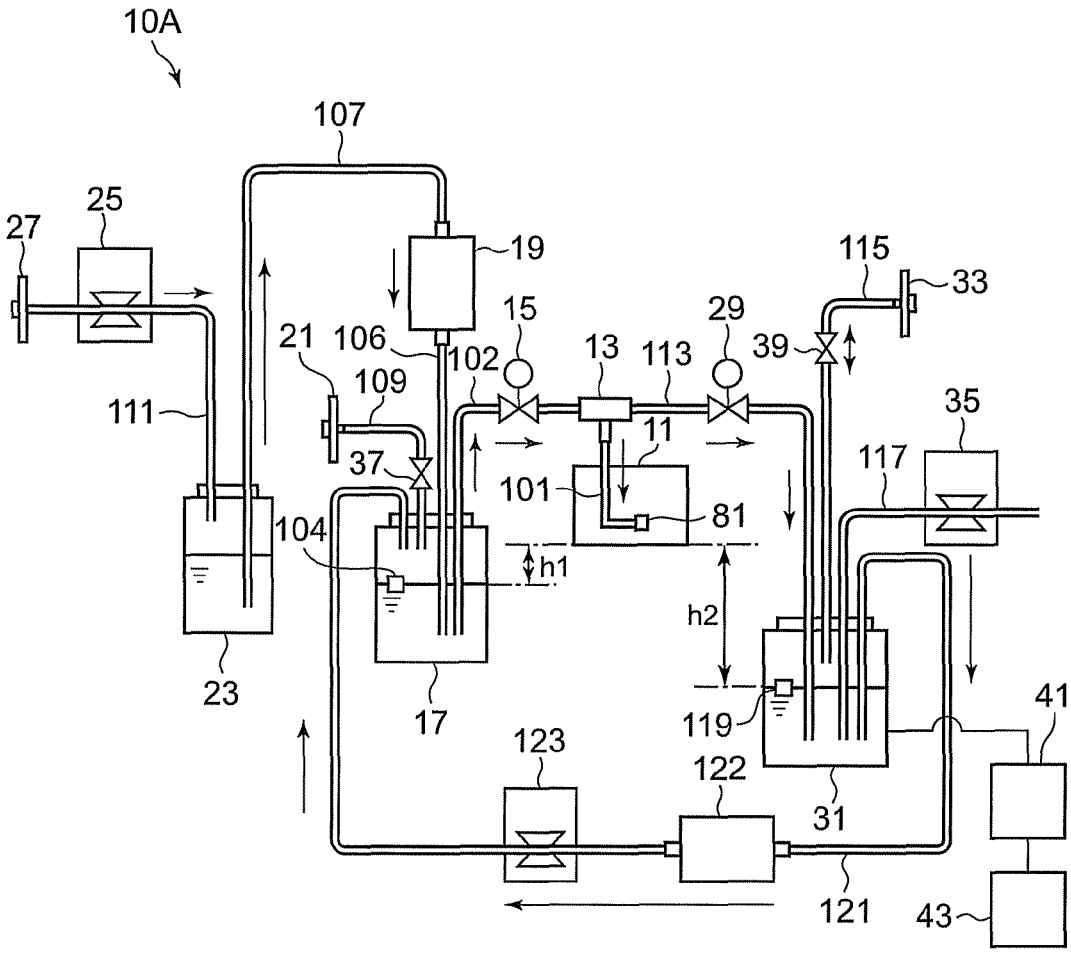
FIG. 17 is a block diagram roughly illustrating construction of a printing apparatus according to a second embodiment.

FIG. 17 is a block diagram roughly illustrating the constructions of a printing apparatus 10A according to the second embodiment. As shown in the FIG. 17, the printing apparatus 10A further includes a circulation path 121, a second filter 122 and a circulation pump 123.

The circulation path 121 is connected between the pressure regulation tank 17 and the lower-stream side ink tank 31. One of the ends of the circulation path 121 is slightly apart from the ink surface in the pressure regulation tank 17. The other end of the circulation path 121 is inserted into the ink in the lower-stream side ink tank 31 such that it is slightly apart from the bottom surface of the lower-stream side ink tank 31.

The second filter 122 is arranged at the circulation path 121. The second filter 122 removes a foreign substance contained in the ink flowing from the lower-stream side ink tank 31 to the pressure regulation tank 17. Therefore, ink from which a foreign substance is removed is supplied to the pressure regulation tank 17.

The circulation pump 123 is also arranged at the circulation path 121. When the circulation pump 123 is operated, the ink stored in the lower-stream side ink tank 31 is conveyed to the pressure regulation tank 17 through the circulation path 121.

The control section 43 judges whether or not an amount of the ink stored in the lower-stream side ink tank 31 is increased from the prescribed amount based on the output of the second hydraulic head sensor 119. If the amount of the ink in the lower-stream side ink tank 31 is increased from the prescribed amount, the control section 43 activates the circulation pump 123.

Then, the ink discharged to the lower-stream side ink tank 31 is returned to the pressure regulation tank 17 by the operation of the circulation pump 123. In other words, the ink is circulated through the pressure regulation tank 17, the ink jet head 11 and the lower-stream side ink tank 31.

According to the printing apparatus 10A having the above construction, the ink stored in the lower-stream side ink tank 31 is fed to the pressure regulation tank 17 by the circulation pump 123. Therefore, the consumption amount of the ink is decreased.

According to the printing apparatus of at least one embodiment described above, the ink in the pressure chamber is discharged to the second tank by the discharging device, the ink in the first tank is charged to the pressure chamber by the supplying device, and the liquid surface of the ink supplied to the pressure chamber is located at the outside of the inkjet head from the nozzle, whereby the printing failure with the caked ink can be restrained.

The present invention has been described with respect to specific embodiments. However, these embodiments have been presented by way of example only. Other embodiments based on the principles of the present invention should be obvious to those of ordinary skill in the art. Such embodiments are intended to be covered by the claims.

What is claimed is:

1. An image forming apparatus comprising:

an ink jet head, including a pressure chamber to which ink is charged, a flow path fluidly communicating with the pressure chamber and a nozzle open to the pressure chamber, which is configured to eject ink in the pressure chamber from the nozzle;

a first tank, connected to the flow path of the head, which is configured to store ink;

a supply unit configured to supply the ink in the first tank to the pressure chamber of the head through the flow path of the head;

a second tank, connected to the flow path of the head, which is configured to store ink;

a tank moving mechanism configured to vertically move the second tank to a position lower than that of the head so that the ink in the pressure chamber of the head is discharged to the second tank through the flow path of the head; and a control section configured to activate the supply unit and the tank moving mechanism so that the ink in the pressure chamber is discharged to the second tank by the tank moving mechanism, the ink in the first tank is charged to the pressure chamber by the supply unit and the liquid surface of the ink supplied to the pressure chamber is projected from the nozzle of the head to discharge a caked ink in the ink in the nozzle of the head.

2. The apparatus according to claim 1, wherein the tank moving mechanism vertically moves the second tank to discharge the ink in the pressure chamber of the head to the second tank by decreasing the pressure in the nozzle of the head.

3. The apparatus according to claim 2, wherein the tank moving mechanism decreases the pressure in the nozzle such that the height difference in the liquid surface between the ink in the nozzle of the head and the ink in the second tank is increased by vertically moving the second tank.

4. The apparatus according to claim 3, further including a pump which discharges the ink in the second tank to decrease the liquid surface of the ink stored in the second tank, and increases the height difference in the liquid surface between the ink in the nozzle of the head and the ink stored in the second tank.

5. The apparatus according to claim 3, wherein the head includes a drive element which pressurizes the ink supplied to the pressure chamber to project the liquid surface of the ink in the pressure chamber to the outside of the head by pressurizing the ink supplied to the pressure chamber by the drive element.

6. The apparatus according to claim 5 further comprising a circulation path connected between the first tank and the second tank, and a circulation pump configured to convey the ink stored in the second tank to the first tank through the circulation path.

7. The apparatus according to claim 4, wherein the head includes a drive element which pressurizes the ink supplied to the pressure chamber to project the liquid surface of the ink in the pressure chamber to the outside of the head by pressurizing the ink supplied to the pressure chamber by the drive element.

8. The apparatus according to claim 7 further comprising a circulation path connected between the first tank and the second tank, and a circulation pump configured to convey the ink stored in the second tank to the first tank through the circulation path.

9. A method for performing maintenance of an image forming apparatus, comprising an ink jet head, having a pressure chamber to which ink is charged, a flow path fluidly communicating with the pressure chamber and a nozzle open to the pressure chamber, which is configured to eject ink in the pressure chamber from the nozzle, a first tank, connected to the flow path of the head, which is configured to store ink, a supply unit configured to supply the ink in the first tank to the pressure chamber of the head through the flow path of the head, a second tank, connected to the flow path of the head, which is configured to store ink, tank moving mechanism configured to vertically move the second tank, and a control section configured to activate the supply unit and the tank moving mechanism, which includes:

vertically moving the second tank to a position lower than that of the head by the tank moving mechanism to discharge the ink in the pressure chamber of the head to the second tank through the flow path of the head;

charging the ink in the first tank to the pressure chamber by the supply unit; and projecting the liquid surface of the ink supplied to the pressure chamber from the nozzle of the head to discharge a caked ink in the ink in the nozzle of the head.

10. The method according to claim 9, wherein the tank moving mechanism moves the second tank to discharge the ink in the pressure chamber to the second tank by decreasing the pressure in the nozzle of the head.

11. The method according to claim 10, wherein the tank moving mechanism decreases the pressure in the nozzle such that the height difference in the liquid surface between the ink in the nozzle of the head and the ink in the second tank is increased by vertically moving the second tank.

12. The method according to claim 11, further including a pump which discharges ink in the second tank to decrease the liquid surface of the ink stored in the second tank, and increases the height difference in the liquid surface between the ink in the nozzle of the head and the ink stored in the second tank.

13. The method according to claim 12, wherein the head includes a drive element which pressurizes the ink supplied to the pressure chamber and the drive element projects the liquid surface of the ink in the pressure chamber to the outside of the head by pressurizing the ink supplied to the pressure chamber.

14. The method according to claim 13, wherein the image forming apparatus comprises a circulation path connected between the first tank and the second tank, a circulation pump, arranged at the circulation path, which conveys the ink stored in the second tank to the first tank, including:

conveying the ink, that is discharged to the second tank by the tank moving mechanism, to the first tank by the circulation pump through the circulation path.

15. The method according to claim 12, wherein the head includes a drive element which pressurizes the ink supplied to the pressure chamber and the drive element projects the liquid surface of the ink in the pressure chamber to the outside of the head by pressurizing the ink supplied to the pressure chamber.

16. The method according to claim 15, wherein the image forming apparatus comprises a circulation path connected between the first tank and the second tank, a circulation pump, arranged at the circulation path, which conveys the ink stored in the second tank to the first tank, including:

conveying the ink, that is discharged to the second tank by the tank moving mechanism, to the first tank by the circulation pump through the circulation path.

* * * * *